US005086985A

United States Patent [19]

Landolt

[11] Patent Number: 5,086,985

[45] Date of Patent: Feb. 11, 1992

[54] YARN GUIDE DRUM

[75] Inventor: Claus-Dieter Landolt, Mönchengladbach, Fed. Rep. of Germany

[73] Assignee: W. Schlafhorst AG & Co., Mönchengladbach, Fed. Rep. of Germany

[21] Appl. No.: 678,593

[22] Filed: Apr. 1, 1991

[30] Foreign Application Priority Data

Mar. 31, 1990 [DE] Fed. Rep. of Germany ..... 4010470

[51] Int. Cl.[5] ..... B65H 54/28; B65H 54/48

[52] U.S. Cl. ..... 242/43.2

[58] Field of Search ..... 242/43.2

[56] References Cited

U.S. PATENT DOCUMENTS

| | | | |
|---|---|---|---|
| 2,998,203 | 8/1961 | Pitts | 242/43.2 |
| 3,945,581 | 3/1976 | Schippers et al. | 242/43.2 X |
| 4,643,372 | 2/1987 | Havelka et al. | 242/43.2 |
| 4,674,696 | 6/1987 | Havelka et al. | 242/43.2 |

FOREIGN PATENT DOCUMENTS

| | | |
|---|---|---|
| 577731 | 4/1958 | Belgium . |
| 527468 | 6/1931 | Fed. Rep. of Germany . |
| 658945 | 4/1938 | Fed. Rep. of Germany . |
| 1865058 | 1/1963 | Fed. Rep. of Germany . |
| 1912840 | 3/1965 | Fed. Rep. of Germany . |
| 47-18509 | 6/1972 | Japan . |

*Primary Examiner*—Stanley N. Gilreath

*Attorney, Agent, or Firm*—Herbert L. Lerner; Laurence A. Greenberg

[57] ABSTRACT

A yarn guide drum of a bobbin winder includes a one-piece metal drum body having a jacket surface. A yarn-guiding reversing thread groove is cut into the jacket surface. The reversing thread groove has intersections and is divided into given groove portions in the vicinity of the intersections and other groove portions. The reversing thread groove has a club-like cross-sectional shape in the other groove portions. The reversing thread groove has a rounded groove bottom, a variable depth at least at the intersections, a variable width, a relatively flatter portion, and a relatively deeper portion interrupting the relatively flatter portion defining a groove portion of relatively lesser depth and relatively lesser width through which the yarn initially passes, being followed by a collector pocket groove portion of relatively greater width which decreases in width as the groove continues. The collector pocket groove portions have lateral reversing thread groove surfaces beginning at the intersections with a concave cross section and a steepness increasing toward the jacket surface and gradually merging with the club-like cross-sectional shape with increasing distance from the intersections.

10 Claims, 3 Drawing Sheets

Fig. 1
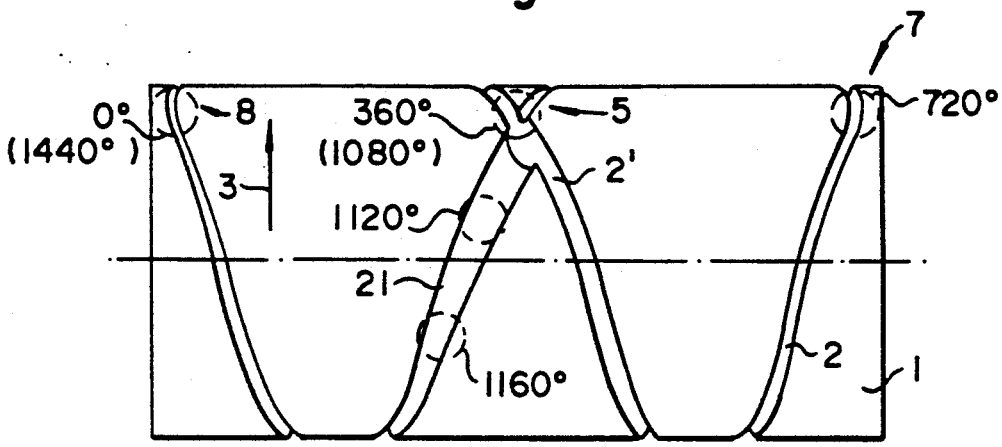
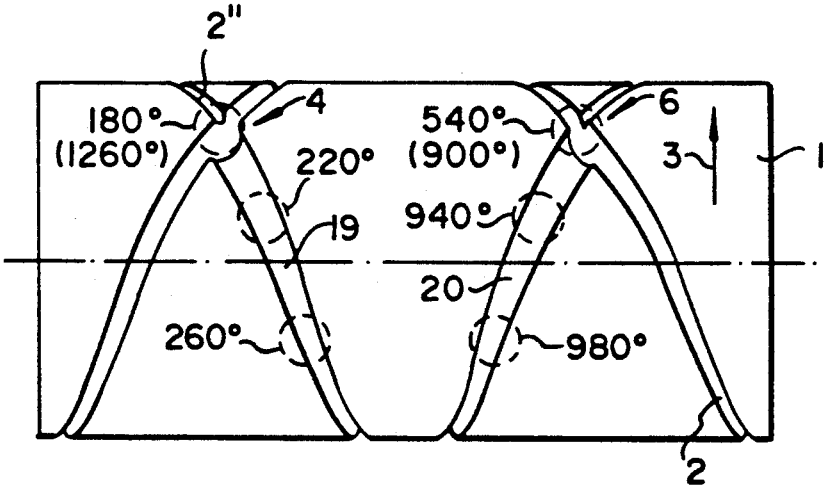
Fig. 2

Fig.3
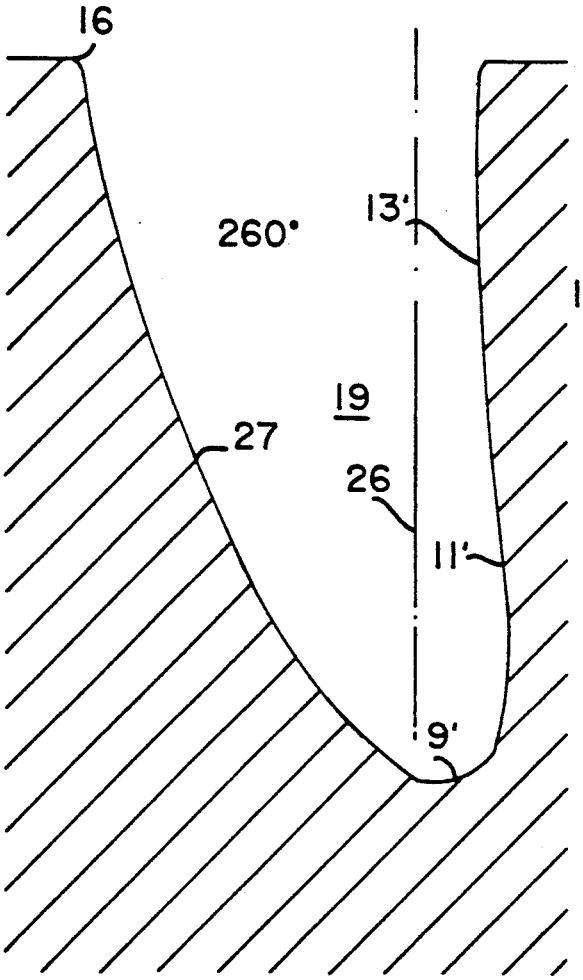
Fig.4
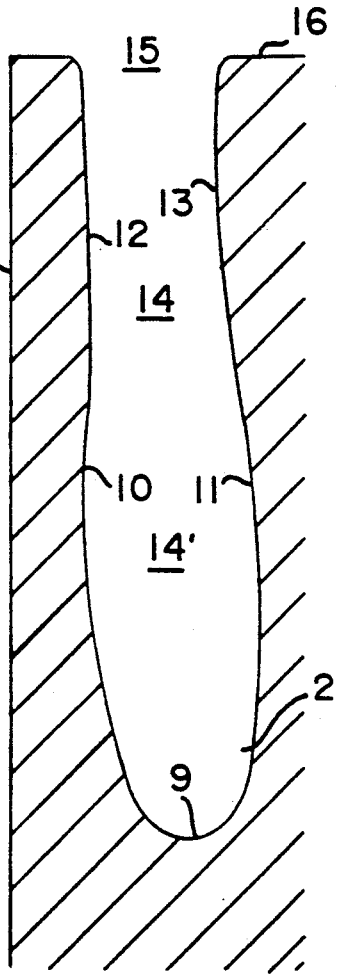
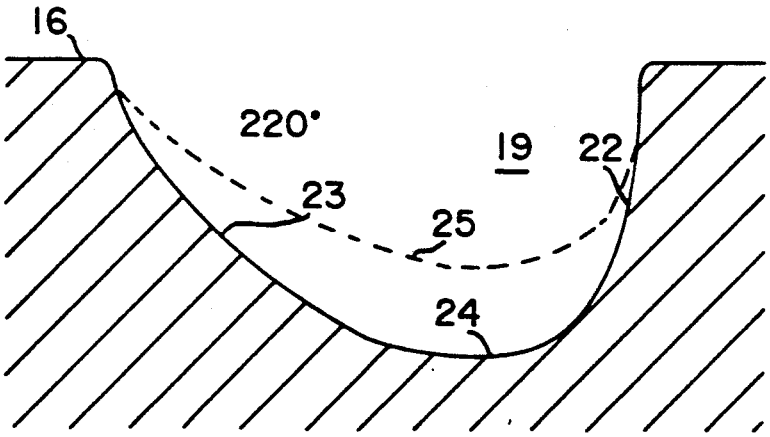
Fig.5

Fig.6
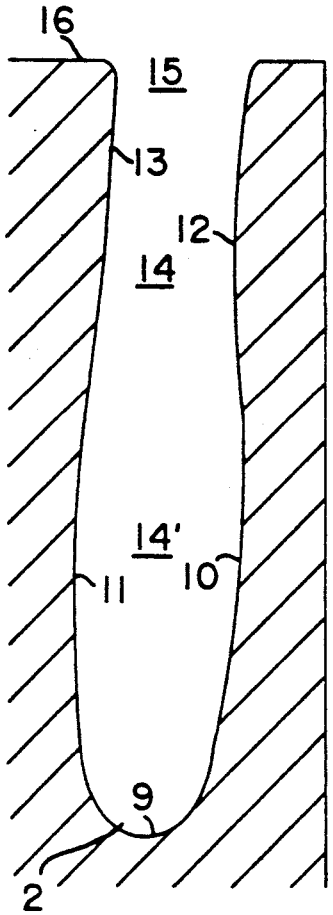
Fig.7
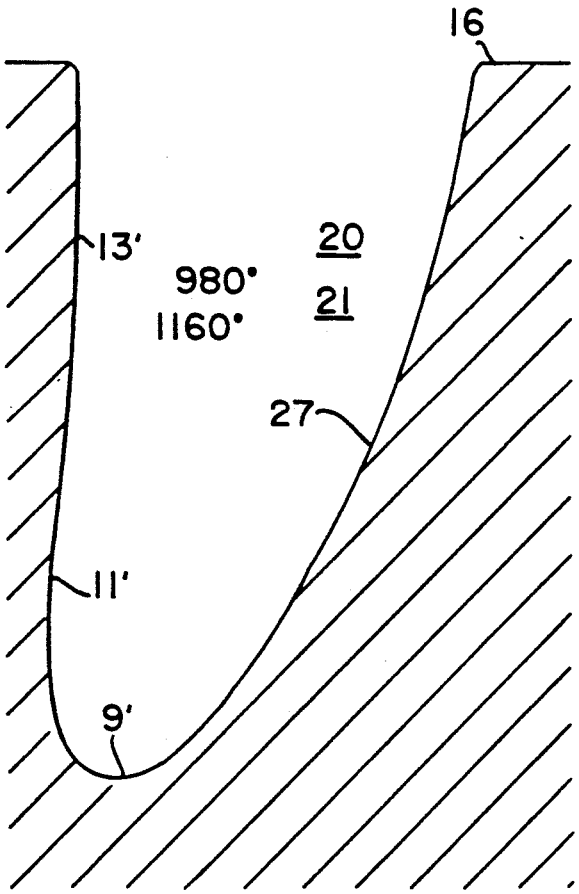
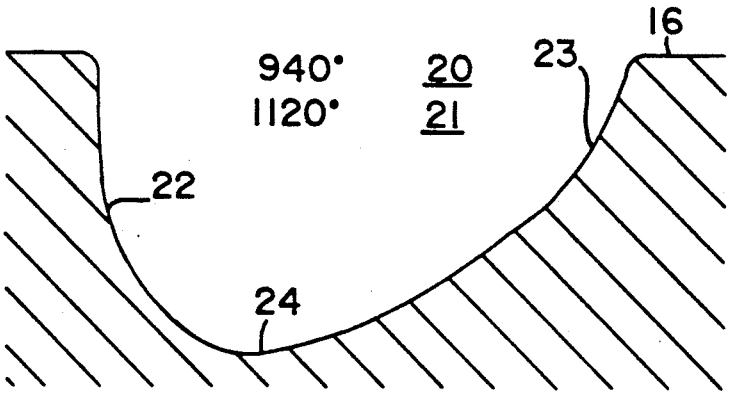
Fig.8

YARN GUIDE DRUM

The invention relates to a yarn guide drum of a bobbin winder, having a reversing thread groove guiding the yarn with a variable depth at least at intersections with respect to the reversing thread groove, a variable width, and a deeper portion of the groove interrupting a flatter portion of the groove in such a way that a groove portion of lesser depth and lesser width through which the yarn passes first is followed by a groove portion of greater width, which is also known as a "collector pocket" having a width which decreases as it goes.

Yarn guide drums are used not only to guide yarn but in general they also drive cross-wound bobbins that are in frictional contact with them.

Such yarn guide drums have been repeatedly improved, for instance as in Japanese Published, Prosecuted Petty Patent Application No. 47-18 509 or Belgian Patent No. 577 731.

Despite all the improvements that have been made for various purposes, the winding speed of such drums is still limited. Repeatedly occurring winding flaws of various types, such as an escape of the yarn from the reversing thread groove or its migration backward from an intersection in the opposite direction, have previously prevented an increase in the winding speed.

It has been recognized that the shaping of the reversing thread groove has a decisive influence on the maximum possible winding speed.

It is accordingly an object of the invention to provide a yarn guide drum, which overcomes the hereinaforementioned disadvantages of the heretofore-known devices of this general type and which increases the winding speed attainable with a yarn guide drum.

With the foregoing and other objects in view there is provided, in accordance with the invention, a yarn guide drum of a bobbin winder, comprising one-piece, compact metal drum body having a jacket surface, a yarn-guiding reversing thread groove being cut into the jacket surface, the reversing thread groove having a variable depth at least at intersections with respect to the reversing thread groove, a variable width, a deeper portion of the groove interrupting a flatter portion of the groove in such a way that a groove portion of lesser depth and lesser width through which the yarn passes first is followed by a groove portion of greater width, which is also known as a "collector pocket" having a width which decreases as it goes, the reversing thread groove having a rounded groove bottom, and a cross section with a club-like shape except for given groove portions located in the vicinity of the intersections, and beginning at the intersection, the collector pockets having lateral groove surfaces with a concave cross section, and a steepness increasing toward the jacket surface of the drum and gradually merging with the club shape with increasing distance from the intersection.

Thus the reversing thread groove substantially has a club-like cross section over the longest possible length.

In accordance with another feature of the invention, the club-like shape of the grooved cross sections is al the more pronounced the deeper the reversing thread groove becomes.

Due to the structure of the reversing thread groove according to the invention, the yarn is largely secured against escape, even if the winding speed is substantially higher than approximately 1,000 m/min.

The intersections dictate a special shaping of the reversing thread groove. To this end, in accordance with a further feature of the invention, the cross section of the reversing thread groove which becomes flatter toward the intersection gradually merges from the full club shape to a shortened club shape, wherein first a part located above the neck part, then a neck part itself and finally a bellied part of the club-like cross section disappear, until only the tip of the club remains, and the lateral surfaces of the groove appear concave in cross section with their steepness increasing toward the jacket surface of the drum.

Since the part of the reversing thread groove located above the neck part is generally somewhat wider than the neck part, which represents the narrow point, it may be advantageous if the opening width of the reversing thread groove becomes initially smaller and then larger again, with decreasing groove depth. However, these fluctuations in width are not abrupt, but instead are always provided with smooth transitions.

In accordance with an added feature of the invention, the collector pockets are formed with one lateral surface of the groove, as viewed in cross section, being substantially concave, deviating from the club shape, and having a steepness increasing toward the drum jacket surface, and as the groove depth increases it is also completed in cross section by the other lateral surface to make the club shape. This gradual change in shape is reinforced by the fact that the opening width of the collector pocket decreases as the distance from the intersection increases.

The goal of providing all of these features is primarily to guide the yarn securely and to assure the correct transition of the traveling yarn at the intersections, even at a high winding speed. Once the yarn is traveling in one traversing direction, it must not leave that direction at the intersection and traverse to the opposite direction.

In order to prevent changes in direction of the yarn at the reversing points of the traversing motion and to prevent the yarn from escaping from the reversing thread groove, in accordance with an additional feature of the invention, the reversing thread groove has a markedly club-like cross section and a correspondingly great depth and a relatively small width at the opening, in other words in the plane of the surface of the yarn guide drum, at least in portions located away from the turning points by an angle of 90°.

In accordance with yet another feature of the invention, the groove portion having the greater depth has a club-like cross section at the intersections. This club-like cross section interrupts whatever cross section there is of the intersecting groove part at the intersection.

Special shapings of the collector pockets are also claimed as being novel and inventive, because an unfavorably shape of the collector pockets also sets an upper limit to the winding speed.

In accordance with yet a further feature of the invention, the width of the collector pocket is greater than the depth, immediately following the intersections, up to a rotational angle of a maximum of 50° away from the intersection.

In accordance with a concomitant feature of the invention, the concave cross-sectional shape of one lateral surface of the collector pocket changes into the club shape, at the latest from a rotational angle of approximately 90° away from the intersection.

With this kind of shaping of the collector pockets, a compromise is made between good yarn collection properties and good yarn guidance properties. Whichever lateral surface is steeper over its entire height is the yarn guiding lateral surface. In contrast, the other lateral surface, which extends farther horizontally, reinforces the catching and holding of the yarn.

The shaping of the collector pockets according to the invention necessarily means that both lateral surfaces have a relatively wide angle of inclination toward the drum surface. This improves the security of the yarn guidance.

Other features which are considered as characteristic for the invention are set forth in the appended claims.

Although the invention is illustrated and described herein as embodied in a yarn guide drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a diagrammatic, front perspective view of a yarn guide drum;

FIG. 2 is a perspective view of the yarn guide drum in a position which has been rotated through 180 relative to FIG. 1; and FIGS. 3–8 are enlarged, fragmentary, characteristic cross-sectional views through a reversing thread groove guiding yarn.

Referring now to the figures of the drawing in detail and first, particularly, to FIGS. 1 and 2 thereof, there is seen a one-piece, compact, metal yarn guide drum 1 which is provided with a double-threaded reversing thread groove 2. The reversing thread groove 2 is produced with the aid of a five-axis milling machine with a disk milling cutter. The direction of rotation of the yarn guide drum is indicated by an arrow 3.

If a yarn transfer point to a cross-wound bobbin is at 0° (FIG. 1) at the beginning of winding, then after a 180° rotation of the yarn guide drum 1, it is located at an intersection 4 shown on the left in FIG. 2. Like other intersections 5 and 6, this intersection 4 is represented by a phantom circle indicating the number of degrees of the rotational angle of the yarn guide drum 1.

After a further 180° rotation of the yarn guide drum, the yarn transfer point is then located at the intersection 5 which is in the middle in FIG. 1, at a total angle of rotation of 360°. The right-hand intersection 6 is attained at an angle of rotation of 540°. Finally, a right-hand turning point 7 (FIG. 1) is attained after an angle of rotation of 720°.

Up to this point, the yarn has been traversing from left to right. After an angle of rotation of 720°, or in other words at the right-hand turning point 7, the yarn then begins to traverse in the opposite direction, from right to left. At an angle of rotation of 900°, the yarn transfer point again reaches the right-hand intersection 6, at an angle of rotation of 1,080° it reaches the middle intersection 5, at an angle of rotation of 1,260° it reaches the left-hand intersection 4, and at an angle of rotation of 1,440° it reaches the starting point, namely the left-hand turning point 8.

FIGS. 3–8 show some characteristic cross sections of the reversing thread groove 2, in each case looking in the direction of yarn travel. The indication of the rotational angle in the various figures indicates the point at which the groove cross section, which is shown on a larger scale, has been taken.

FIG. 4 shows that the reversing thread groove 2 has a markedly club-like cross-sectional shape in regions located around the 0°, i.e. 1,440°, rotational angle. A fully round groove bottom 9 is followed by concave lateral surfaces or flanks, which initially produces a bellied portion 14' and then a narrowed neck part 14, because concave lateral surface parts 10 and 11 change into convex lateral surfaces 12 and 13, which then continue with greater steepness above the neck part 14 to a jacket surface 16 of the drum and merge with the jacket surface 16 with slightly rounded corners at a groove opening 15. The entire groove cross section is slightly inclined from the groove bottom 9 toward a left lateral surface 17 of the drum. FIG. 6 is the exact mirror image of FIG. 4, showing the cross section of the reversing thread groove 2 in regions that are located in the area before and after the right-hand turning point 7.

FIG. 5 shows a section through a collector pocket 19 at the level of the 220° rotational angle (FIG. 2). A right-hand lateral surface 22 is still reminiscent of the club shape of FIG. 4 and it is relatively steep. A left-hand lateral surface 23 extends from a round groove bottom 24 concavely laterally and upward, and then with relatively major steepness it merges with the jacket surface 16 of the drum. Directly next to the left-hand intersection 4 (FIG. 2), the contour of the collector pocket 19 approximately follows a broken line 25.

FIG. 8 is the exact mirror image of FIG. 5, showing the cross section of a collector pocket 20 or 21 (FIG. 2, FIG. 1) at the level of the rotational angle of 940° and 1,120°, respectively.

FIG. 3 shows the cross section of the collector pocket 19 at the level of the 260° rotational angle (FIG. 2). A right-hand lateral surface 11', 13' has the club-like contouring already explained for the groove cross-section shown in FIG. 4. To the left of an imaginary plane 26 that passes vertically through the axis of rotation of the drum, a left-hand lateral surface 27 extends concavely upward to the left and merges with relatively great steepness with the jacket surface 16 of the drum.

The collector pocket then becomes narrower and narrower over its further course. For a double-threaded reversing thread groove, as in this case, the groove depth must finally decrease again, because the groove is approaching the next intersection in succession.

FIG. 7 is the mirror-image of FIG. 3, showing the cross section of the collector pocket 20 (FIG. 2) and 21 (FIG. 1) at the level of the rotational angles of 980° and 1,160°, respectively.

I claim:

1. A yarn guide drum of a bobbin winder, comprising a one-piece metal drum body having a jacket surface, a yarn-guiding reversing thread groove being cut into said jacket surface, said reversing thread groove having intersections and being divided into given groove portions in the vicinity of said intersections and other groove portions, said reversing thread groove having a club-like cross-sectional shape in said other groove portions, said reversing thread groove having a rounded groove bottom, a variable depth at least at said intersections, a variable width, a relatively flatter portion, and a relatively deeper portion interrupting said relatively flatter portion defining a groove portion of relatively lesser depth and relatively lesser width through which the yarn initially passes. being followed by a collector pocket groove portion of relatively greater width which decreases in width as said groove continues, and said collector pocket groove portions having lateral reversing thread groove surfaces beginning at said intersections with a concave cross section and a steepness increasing toward said jacket surface and gradually merging with said club-like cross-sectional shape with increasing distance from said intersections.

2. The yarn guide drum according to claim 1, wherein said club-like cross-sectional shape is more pronounced where said reversing thread groove is deeper.

3. The yarn guide drum according to claim 1, wherein said club-like cross-sectional shape has a tip, a bellied portion above said tip, a neck part above said bellied portion, and a part above said neck part, and said reversing thread groove has a cross section becoming flatter as seen in a direction toward said intersection and gradually merging from said club-like cross-sectional shape to a shortened club-like cross-sectional shape with said part above said neck part, then said neck part and finally said bellied portion of said club-like cross-sectional shape disappearing until only said tip of said club club-like cross-sectional shape remains, while said lateral surfaces of said reversing thread groove appear concave in cross section and have a steepness increasing toward said jacket surface.

4. The yarn guide drum according to claim 1, wherein as viewed in cross section, one of said lateral reversing thread groove surfaces of said collector pocket groove portions is substantially concave in a deviation from said club-like cross-sectional shape with a steepness increasing toward said jacket surface, and is completed in cross section by another of said lateral reversing thread groove surfaces with increasing depth of said reversing thread groove to make said club-like cross-sectional shape.

5. The yarn guide drum according to claim 1, wherein said reversing thread groove has turning points, portions located away from said turning points by an angle of 90°, an opening, and a markedly club-like cross section, a correspondingly great depth and a relatively small width at said opening, at least in said portions.

6. The yarn guide drum according to claim 1, wherein said reversing thread groove has groove portions including a groove portion with a greater depth having a club-like cross section at said intersections.

7. The yarn guide drum according to claim 4, wherein said collector pocket groove portions have a greater width than depth immediately behind said intersections, up to a rotational angle of a maximum of substantially 50° away from said intersections.

8. The yarn guide drum according to claim 5, wherein said collector pocket groove portions have a greater width than depth immediately behind said intersections, up to a rotational angle of a maximum of substantially 50° away from said intersections.

9. The yarn guide drum according to claim 6, wherein said collector pocket groove portions have a greater width than depth immediately behind said intersections, up to a rotational angle of a maximum of substantially 50° away from said intersections.

10. The yarn guide drum according to claim 4, wherein said concave cross-sectional shape of one of said lateral reversing thread groove surfaces of said collector pocket groove portions changes into said club-like cross-sectional shape beginning with a rotational angle of approximately 90° away from one of said intersections.

* * * * *